US009598895B2

(12) United States Patent
Dintheer

(10) Patent No.: US 9,598,895 B2
(45) Date of Patent: Mar. 21, 2017

(54) DOOR SEALING SYSTEM

(71) Applicant: Planet GDZ AG, Tagelswangen (CH)

(72) Inventor: Andreas Dintheer, Illnau (CH)

(73) Assignee: PLANET GDZ AG, Tagelswangen (CH)

( * ) Notice: Subject to any disclaimer, the term of this patent is extended or adjusted under 35 U.S.C. 154(b) by 0 days.

(21) Appl. No.: 14/401,932

(22) PCT Filed: May 2, 2013

(86) PCT No.: PCT/EP2013/059137

§ 371 (c)(1),
(2) Date: Nov. 18, 2014

(87) PCT Pub. No.: WO2013/171075

PCT Pub. Date: Nov. 21, 2013

(65) Prior Publication Data

US 2015/0121759 A1 May 7, 2015

(30) Foreign Application Priority Data

May 18, 2012 (EP) ..... 12168484

(51) Int. Cl.

| | |
|---|---|
| ***E06B 7/28*** | (2006.01) |
| ***E06B 7/20*** | (2006.01) |
| ***E06B 7/02*** | (2006.01) |
| ***E06B 7/215*** | (2006.01) |
| ***E06B 5/10*** | (2006.01) |
| ***E06B 5/20*** | (2006.01) |

(52) U.S. Cl.
CPC ..... *E06B 7/20* (2013.01); *E06B 5/10* (2013.01); *E06B 5/20* (2013.01); *E06B 7/02* (2013.01); *E06B 7/215* (2013.01); *E06B 7/28* (2013.01); *E06B 2007/023* (2013.01); *E06B 2007/202* (2013.01)

(58) Field of Classification Search
CPC ..... E06B 7/20; E06B 5/10; E06B 5/20; E06B 7/28; E06B 7/215; E06B 7/02
See application file for complete search history.

(56) References Cited

U.S. PATENT DOCUMENTS 9,085,933 B1 * 7/2015 Crittenden ..... E06B 3/5892
2002/0081963 A1 * 6/2002 Wasson ..... E06B 7/02 454/195

(Continued)

FOREIGN PATENT DOCUMENTS

DE 29916090 U1 2/2001
EP 0338974 A2 10/1989

(Continued)

*Primary Examiner* — Gregory Strimbu
(74) *Attorney, Agent, or Firm* — Browdy and Neimark, PLLC

(57) ABSTRACT

A door sealing system includes a door seal for sealing either an upper or a lower side of a building door wing, and an air channel which enables, when the door seal is in the sealing position, air to circulate from a longitudinal side of the door seal to an opposite longitudinal side of the door seal. The door sealing system also includes at least one ventilator that guides air through the air channel. The door sealing system enables sufficient air to be exchanged even when the door wing is closed.

9 Claims, 7 Drawing Sheets

(56) References Cited

U.S. PATENT DOCUMENTS

| | | | | |
|---|---|---|---|---|
| 2007/0051244 | A1* | 3/2007 | Chang | E06B 7/20 96/226 |
| 2009/0302995 | A1* | 12/2009 | Park | E06B 7/02 340/3.1 |

FOREIGN PATENT DOCUMENTS

| | | | |
|---|---|---|---|
| EP | 0509961 | A1 | 10/1992 |
| EP | 1085162 | A2 | 3/2001 |
| EP | 1498569 | A1 | 1/2005 |
| EP | 1936097 | A1 | 6/2008 |
| WO | 2010142053 | A1 | 12/2010 |

* cited by examiner

DOOR SEALING SYSTEM

TECHNICAL FIELD

The present invention relates to a door sealing system.

PRIOR ART

Door seals are used in regions where sound protection and draft protection are desired. They are also intended to provide a lighttight seal. Simple door seals are what are referred to as friction seals, the sealing lip or brush of which protrudes downward over a lower end surface of the door wing.

Furthermore, lowerable door seals are known, which door seals customarily substantially consist of a housing in the form of a downwardly open, U-shaped profile rail, a sealing strip which is held in said housing and is displaceable relative thereto and has a sealing element, and a drive mechanism for lowering or for raising the sealing strip. The sealing strip is customarily lowered automatically when the door is closed by a force acting on an actuating rod in the longitudinal direction and setting the mechanical lowering mechanism into operation. However, it is also possible to provide a manually actuable drive mechanism. Door seals of this type are known, for example from EP 0 338 974, DE 299 16 090 and EP 0 509 961. Said door seals have been tried and tested. In particular the door seal according to EP 0 338 974 is distinguished by a particularly efficient sealing performance owing to the single-piece sealing lip, the limbs of which bear in a sliding manner against the guide rail.

However, these seals cannot be used in low- or zero-energy houses with controlled ventilation, in particular in Minergie® houses. Buildings of this type have a ventilation system which blows air into some of the rooms via ventilation grilles in the wall, in the floor or in the ceiling and extracts said air in other rooms via extraction openings likewise arranged in the wall, in the ceiling or in the floor. The aim of the ventilation is to heat fresh air sucked in from the outside by means of the used air flowing outward in order thereby to minimize the energy requirement for heating the rooms. Each room here can preferably have an air supply and removal opening which is connected to the ventilation system. In more cost-effective variants, air is exchanged between the rooms, with small ventilation grilles being arranged for this purpose in the door or the walls. Alternatively, the doors do not close entirely tightly so that the exchange of air is ensured. A relatively large gap is customarily left between lower door edge and the floor.

As a result, however, there is no sound protection and light glimmers from one room into the other.

It has therefore been proposed in EP 1 498 569 to provide pressure equalizing openings in the sealing lip or in the seal housing. However, said pressure equalizing openings are sometimes insufficient for appropriate ventilation of the rooms.

EP 1 936 097 discloses a door sealing system for use in Minergie® houses. The seal housing is arranged in an outer rail, wherein a continuous air duct runs between said two rails from one side to the other side of the door. Sound damping elements in form of rock wool or felt inserts are arranged in the air duct. Said sound damping elements are intended to permit a certain degree of sound protection.

WO 2010/142053 proposes a door sealing system with an air duct which ensures that air circulates from a first side of the door wing to a second side of the door wing. In order to improve the sound protection, there is a sound-absorbing resonator in the air duct. The resonator can be formed by the door seal itself, for example by the guide rail or by an outer rail surrounding the guide rail.

However, in particular in the closed rooms, there is an increased requirement for renewing the air and therefore an increased requirement for exchanging air with adjacent rooms. This is customarily achieved by fans which are arranged in wall apertures. Said fans are visible to everybody and may have a negative influence on the esthetics of the room. Retrospective installation of fans of this type causes a relatively great structural change since the wall aperture has to be created. In addition, the air flow produced in the room is frequently found annoying.

SUMMARY OF THE INVENTION

It is therefore an object of the invention to permit an increased renewal of air in rooms without having an adverse effect on the freedom of designing said rooms. In particular, the renewal of air in existing buildings is intended to be improved without great structural changes.

The door sealing system according to the invention has a door seal for sealing a lower side or upper side of a building door wing, and an air duct which, in a sealing position of the door seal, permits air to circulate from one side of the door wing and the longitudinal side of the door seal to the opposite side of the door wing and the opposite longitudinal side of the door seal. According to the invention, the door sealing system has at least one fan which conducts air through said air duct.

The air duct is therefore located in the region of the door seal and preferably leads around the latter. In addition, the door sealing system forms an active element for ventilating the room.

The combination of the air duct, which is present in the door sealing system, with at least one fan improves the exchange of air without great structural measures. In addition, said ventilation system is virtually invisible since it is located in the lower or upper region of the door wing. Existing structures can be retrofitted in a simple manner by either the entire door wing being replaced or existing door wings being retrofitted with said sealing system including fans. The circulating air flow preferably extends over the entire width of the door and is thus scarcely noticeable. The system according to the invention can be effectively used in buildings without central ventilation. However, said system can also be used in combination with a central house ventilation system.

The at least one fan is preferably operated by motor, preferably operated by electric motor.

The fan can be supplied with power via the in-house mains or via a battery.

The at least one fan can be uninterrupted in operation and/or can be switched on and off manually. In a preferred embodiment, said fan is switched on when the door wing is closed and is switched off when the door wing is opened. The switching on and off can take place, for example, via a switch which is activated when the door is closed or by a current circuit closing in another manner. The switching on and off can also take place by lowering an raising of the door seal. If the switching on and off is coupled to a movement of the door seal, it can also be activated when the door is not closed, for example by the door seal being lowerable manually or by operation of a motor in this state. If the at least one fan is in operation only when the door wing is closed and/or when the seal is lowered, the energy consumption is minimized. Since the fan in this case is used only when required, it also has a longer service life. In one embodiment, the fan is connected to an electronic controlling means which controls the operation of the fan in accordance with external conditions. For example, there can be a $CO_2$ sensor and/or a hydrometer, and the fan can be switched on when a threshold value is exceeded. In a preferred embodiment, the controlling means is a central house controlling means or can be connected to the latter.

The at least one fan is arranged on or in the door wing. Said fan is preferably arranged in the region of the door seal and above the latter. The air duct can thereby be optimally formed, and the effect is increased. Furthermore, the system according to the invention can thereby be formed compactly and in a space-saving manner, and therefore the creative freedom in the design of the door wing is restricted only a little. In particular, the door wing can thereby be formed in such a manner that the door seal and the fan are not conspicuous to the observer at first glance.

The at least one fan is preferably fastened on the door seal or to an outer housing receiving the at least one fan and the door seal. This facilitates the assembly, and only a single groove is required in the door wing in order to receive the entire system. The door sealing system is preferably designed for arrangement in a groove of a door wing and for fastening in or to said door wing. The system can additionally or alternatively be designed for fastening to the lower or upper end side of the door wing, wherein said system protrudes over said door wing. A lateral arrangement in the lower or upper region of the door wing leaf is also possible.

In the door sealing system according to the invention, the fan and the door seal are preferably connected to each other, wherein said connection is approximately airtight. This increases the efficiency.

In preferred embodiments, the at least one fan is a compact or miniature fan. In a preferred embodiment, the at least one fan is a crossflow fan which blows air in the longitudinal direction of the door seal. However, said crossflow fan is designed in such a manner that it conducts air from one longitudinal side of the door seal to the other longitudinal side. This can be achieved, for example, by the formation of a suitable flow duct in a housing of the fan.

There can be more than one crossflow fan. However, just a single crossflow fan is preferably present. The door seal preferably has a first and a second end in its longitudinal direction, wherein the fan is arranged in the region of one of said ends in such a manner that it blows air in the direction of the other end. A second crossflow fan with an opposed orientation can be arranged at the opposite end.

In another embodiment, the at least one fan is at least one axial fan which blows air in a direction transversally with respect to the longitudinal extent of the door seal. A plurality of axial fans are preferably arranged next to one another in the direction of the longitudinal extent of the door seal and in a manner distributed over approximately the entire longitudinal extent of the door seal.

In a preferred embodiment, the door sealing system comprises an outer housing in which the at least one fan and the door seal are arranged. The outer housing preferably has a U-shaped cross section and is designed to be open toward that end side of the door wing which is to be sealed. The air duct in the outer housing is preferably formed between outer walls of the door seal and inner walls of the outer housing.

A common outer housing is not absolutely necessary. Fan and seal can also be fastened jointly or individually to or in the door wing, wherein the fan conducts air along the door seal from one side to the other side. The air duct can be formed, for example, between door seal and groove of the door wing.

If an outer housing is present, said outer housing preferably has two limbs and a web connecting said two limbs, wherein the at least one fan is arranged adjacent to the web.

In order to permit an optimum air duct, the door seal is preferably arranged on both longitudinal sides at a distance from the outer housing.

The door seal can be a friction seal with a sealing lip or brush. However, said door seal preferably has a sealing element which is automatically lowerable when the door wing is closed and automatically raisable when the door wing is opened. The sealing element can be actuable magnetically, in a manner operated by motor or inductively. However, it is preferably activatable mechanically, for example in a spring-loaded manner. The lowering mechanisms which are mentioned at the beginning and have an actuating rod which is activatable on one side are preferred embodiments.

The door wing can be a pivotable door wing or part of a sliding door.

Further embodiments are indicated in the dependent claims.

BRIEF DESCRIPTION OF THE DRAWINGS

Preferred embodiments of the invention are described below with reference to the drawings which serve merely for explanation and should not be interpreted as being limiting. In the drawings.

DESCRIPTION OF PREFERRED EMBODIMENTS

FIGS. 1 to 6 illustrate a first exemplary embodiment of the door sealing system according to the invention.

Figure 1:
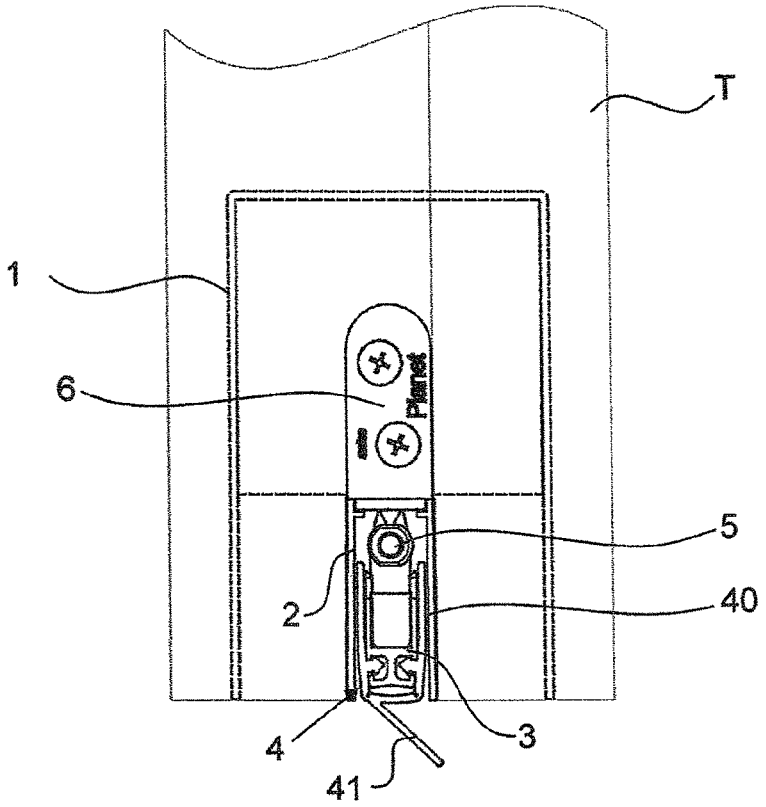
FIG. 1 shows a side view of a door sealing system according to the invention in a first embodiment, fastened in a groove of a door wing.

According to FIG. 1, said door sealing system is fastened in a groove N which is present in a lower edge of a door wing T. The door sealing system can alternatively also be arranged on an upper end edge, on a lateral surface of the door wing T or on a lower or upper end surface of the door wing T.

Figure 2A:
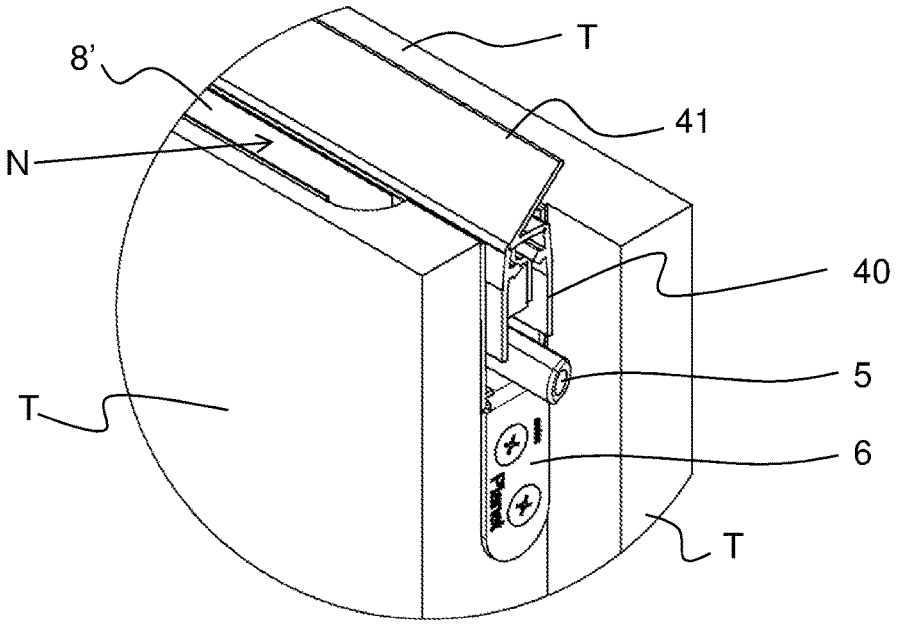
FIG. 2*a* shows a first perspective illustration of the door wing with groove and door sealing system according to FIG. 1.
Figure 2B:
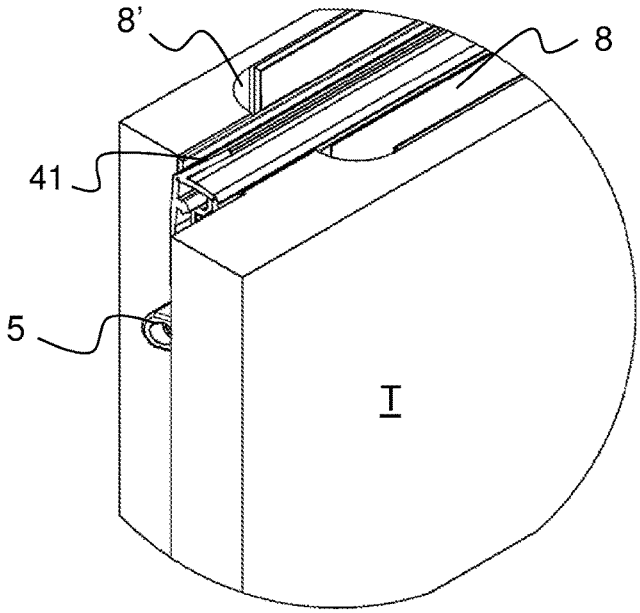
FIG. 2*b* shows a second perspective illustration of the door wing with groove and door sealing system according to FIG. 1.

As can be seen in FIGS. 2*a* and 2*b*, the U-shaped groove N is of stepped or offset design. At at least one, preferably at both lateral ends of the groove N, the latter is designed to be narrower and less deep than in the central region. However, the groove N can also have a width and depth which are constant over its entire length.

The door sealing system is fastened to or in the door wing T by known means. In particular, there can be an outer housing 1 which receives all of the parts of the door sealing system and is of cap-shaped design with limbs parallel to the end surface of the door wing T. Said limbs are preferably screwed onto the end surface of the door wing T. This type of fastening is suitable for grooves formed in a constant manner and also for stepped grooves.

Figure 4:
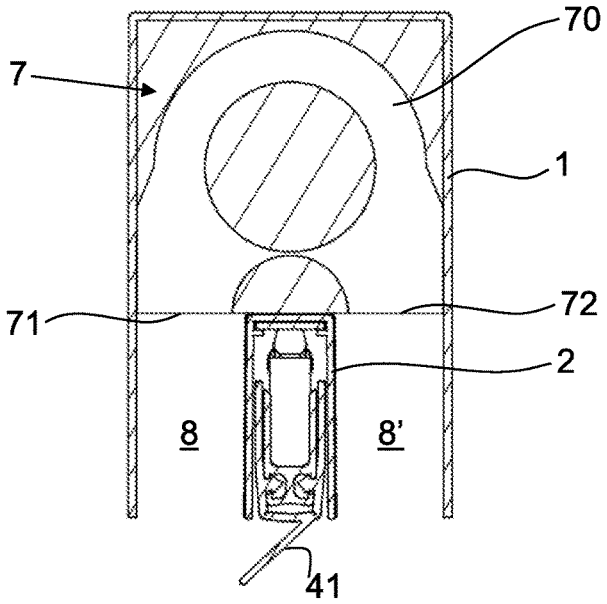
FIG. 4 shows a cross section through the door sealing system according to FIG. 3 along the line Iv-Iv, with a crossflow fan arranged in a centered manner.

In the embodiment illustrated here, the outer housing 1 has a U-shaped cross section as can readily be seen in FIG. 4. The outer housing can be embedded in a recessed manner in the groove N or, as illustrated in FIGS. 1 and 2, can end flush with the lower edge of the door wing T. Although protruding outer housings 1 are likewise possible, they are, however, less desirable in practice.

The outer housing 1 encloses a seal housing 2 of a door seal. Outer housing 1 and seal housing 2 are preferably profiled rails made from aluminum or plastic. The seal housing 2 preferably likewise has a substantially U-shaped cross section and has a web and also two limbs which are connected to each other by said web and run parallel to each other.

Figure 3:
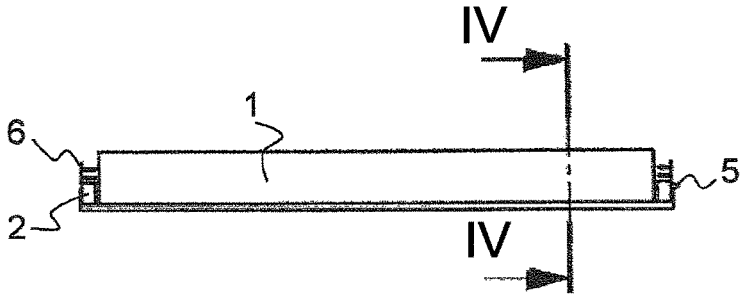
FIG. 3 shows a side view of the door sealing system according to FIG. 1.

The door seal is preferably designed as a lowerable seal as is known from the prior art. In this example, the seal housing 2 contains a support profiled rail 3, a sealing element 4 fastened to the support profiled rail 3 and a lowering mechanism (not illustrated), wherein the support profiled rail 3 and the sealing element 4 are jointly raisable and lowerable relative to the seal housing 2 via said lowering mechanism. The sealing element 4 is formed here as a single piece and, in this example, has lateral limbs 40 bearing against the seal housing 2 and a sealing lip 41 which protrudes in a manner protruding obliquely downward and extends over the entire length of the seal. However, the sealing element 4 can also be of multi-piece design and/or can have a different shape and different fastening points to the support profiled rail 3, to the seal housing 2 or to other points of the seal. The lowering mechanism preferably has leaf springs which are actuable via an actuating rod running parallel to the longitudinal direction of the seal. The actuating rod ends in an actuating knob 5 which protrudes on one side of the door seal, as can be seen in FIG. 3. When the door wing T is closed, the actuating knob is therefore pushed in and the force is transmitted to the leaf springs.

Other types of lowering mechanisms and other types of door seals, in particular friction seals and brushes, can likewise be realized with the concept according to the invention.

In this example, the seal housing 2 protrudes on both sides with respect to the outer housing 1, as can be seen in FIG. 3. The sealing system according to the invention can thereby be mounted in an offset groove N of the door wing T. For this purpose, there is an angle bracket 6 which engages by one limb under the web of the seal housing 2 and by a second limb, which is approximately perpendicular to the first limb, is screwed onto the end surface of the door wing T. This can readily be seen in FIG. 1. The sealing system mounted in this manner is scarcely visible from the outside, and only the end sides can be seen.

The seal housing 2 is arranged spaced apart in the outer housing 1 such that an intermediate space 8, 8' is produced on both of its longitudinal sides. Said intermediate spaces 8, 8' form part of an air duct.

Figure 6:
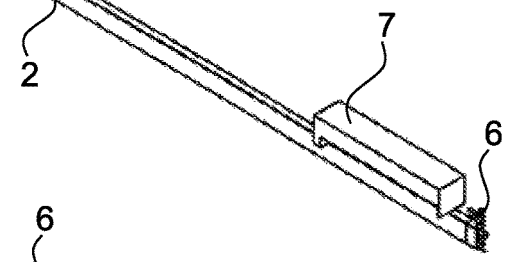
FIG. 6 shows a perspective illustration of the door sealing system according to FIG. 3 without an outer housing.

The door sealing system according to the invention furthermore has at least one ventilator or fan 7. The fan 7 is arranged above the web of the seal housing 2, as can be seen in FIGS. 4 and 6. The fan 7 is preferably fastened on the web of the seal housing 2, for example is screwed, clamped or adhesively bonded or sealed in some other way thereon.

Figure 5:
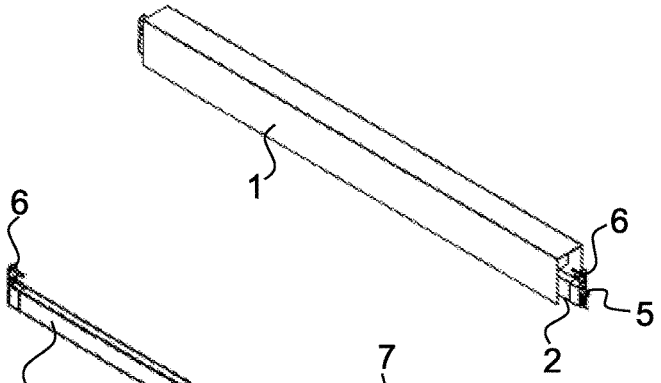
FIG. 5 shows a perspective illustration of the door sealing system according to FIG. 3.

The fan 7 is surrounded by the outer housing 1, as can be seen in FIG. 5. The fan 7 can additionally or alternatively also be fastened on or in the outer housing 1.

This fan 7 is preferably designed as a miniature fan, and therefore it is designed in as space-saving a manner as possible and is actuable with little energy consumption. It can be battery-operated or is connected or connectable to the mains. A connection to the mains can take place via a contact, for example in the door frame, for example when the door is closed. There can also be cable junctions, for example, with respect to the door lock.

The fan 7 is arranged in the region of one end of the seal. However, said fan is preferably located at a distance from the end of the seal housing 2. This permits the arrangement in an offset groove N of the door wing T. A plurality of transverse fans of this type can also be used. In particular, a transverse fan can likewise be arranged in the region of the other end of the seal housing 2. However, at least one fan 7 is preferably arranged in the region of that end to which the door wing T is fastened pivotably in the door frame; i.e. on the hinge side.

In this embodiment, the fan 7 is a crossflow fan. It blows air along the longitudinal direction of the seal housing 2. However, the fan 7 has a flow duct 70 with an inlet 71 on one longitudinal side of the seal housing 2 and an outlet 72 on the opposite longitudinal side of the seal housing 2. This can be achieved, for example, as illustrated here by suitable design of the fan housing. The inlet 71 leads into the first intermediate space 8 on a first longitudinal side of the seal housing 2. The outlet 72 leads into the second intermediate space 8' on the second, opposite longitudinal side of the seal housing 2. This can readily be seen in FIG. 4. This fan 7 thereby conducts air from one side of the door wing to the other side and therefore from one room of the building into another. The intermediate spaces 8, 8' and the flow duct 70 therefore form the air duct. It is ensured by means of this arrangement, that, even when the door is closed and when the door seal is lowered, a sufficient exchange of air can take place between the rooms. This is even possible for a particular central ventilation system.

Figure 7:
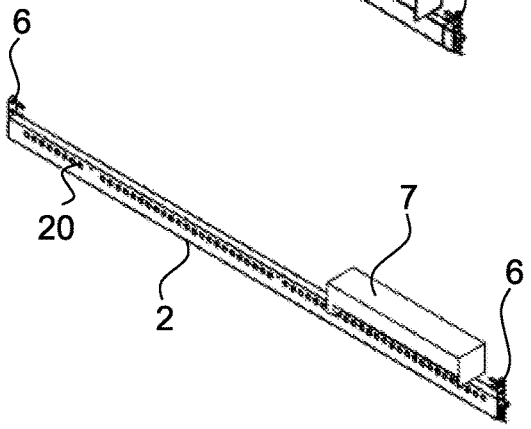
FIG. 7 shows a perspective illustration of a door sealing system according to the invention without an outer housing in a second embodiment.

FIG. 7 illustrates a first variant of the door sealing system according to the invention according to FIGS. 1 to 6. The seal housing 2 is provided here with holes 20 in order to act as a sound-absorbing resonator. Other types of resonators, in particular those disclosed in WO 2010/142053, can likewise be used in the door sealing system according to the invention.

Figure 8:
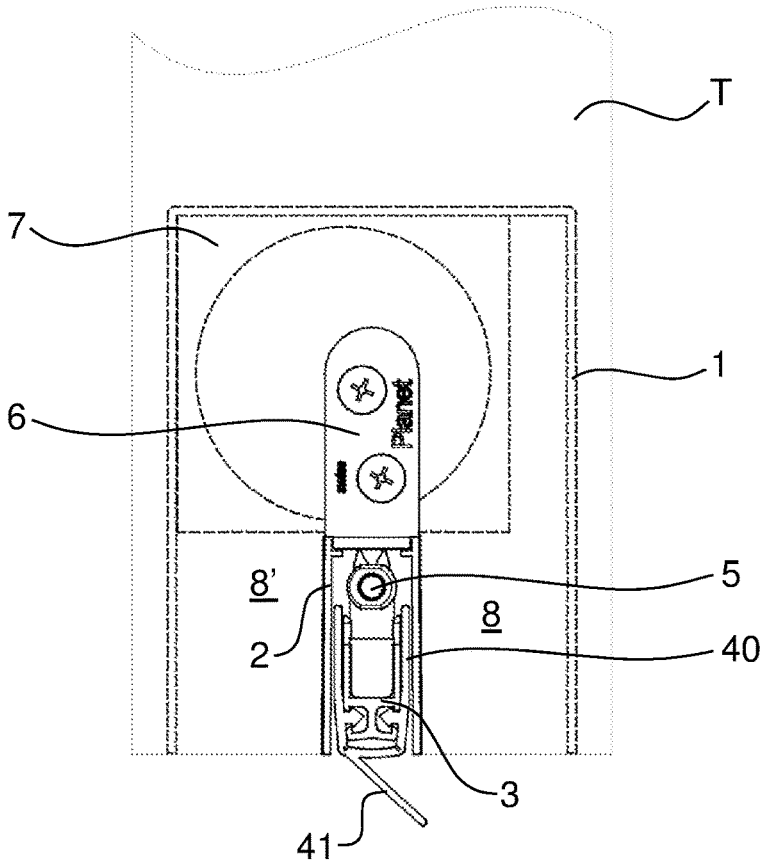
FIG. 8 shows a view of a door sealing system according to the invention according to a third embodiment, with a crossflow fan arranged non-centrally.
Figure 9:
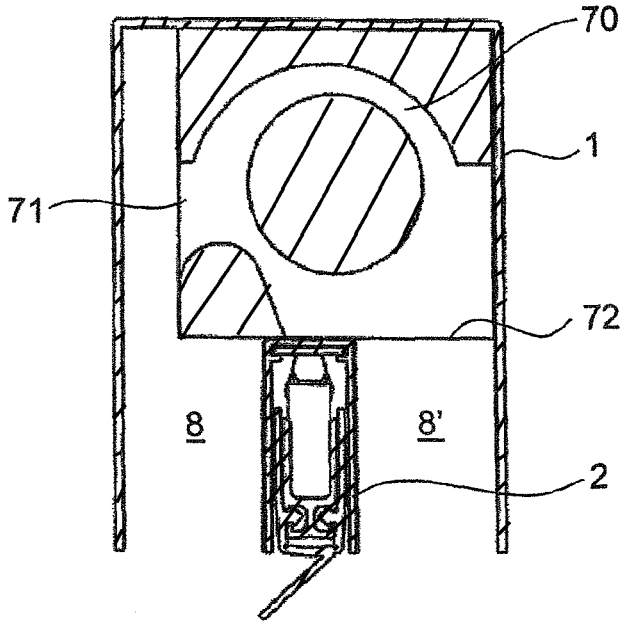
FIG. 9 shows a cross section through the door sealing system according to FIG. 8.
Figure 10:
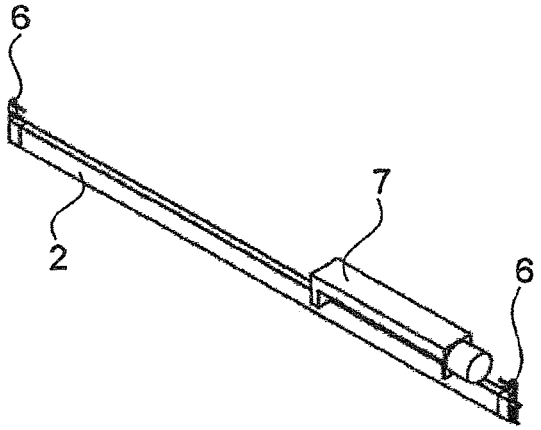
FIG. 10 shows a perspective illustration of the door sealing system according to FIG. 8 without an outer housing.

FIGS. 8 to 10 illustrate a further exemplary embodiment of the door sealing system according to the invention. A transverse fan 7 is also present here. Said transverse fan is, however, arranged non-centrally in the outer housing 1, and therefore the inlet 71 of said transverse fan is not directed downward, as in the embodiments according to FIGS. 1 to 6, but rather is directed laterally toward the side wall of the outer housing 1. The outlet 72 of said transverse fan is directed downward in this example. Alternatively, however, the inlet 71 can be oriented downward and the outlet 72 can be oriented laterally.

In a further embodiment (not illustrated here), inlet and outlet 71, 72 can end laterally. For this purpose, the outer housing 1 merely has to be designed to be wider than the fan 7. The fan 7 here can be arranged non-centrally or centrally in the outer housing 1 as long as an air duct is formed from one side to the other side of the seal.

In all of these embodiments, the seal housing 2 is preferably arranged centrally, i.e. in the outer housing 2 along the longitudinal center axis thereof. However, said seal housing can also be arranged non-centrally.

Furthermore, the variations mentioned in the first exemplary embodiment, including the use of resonators, are also possible in this embodiment.

Figure 11:
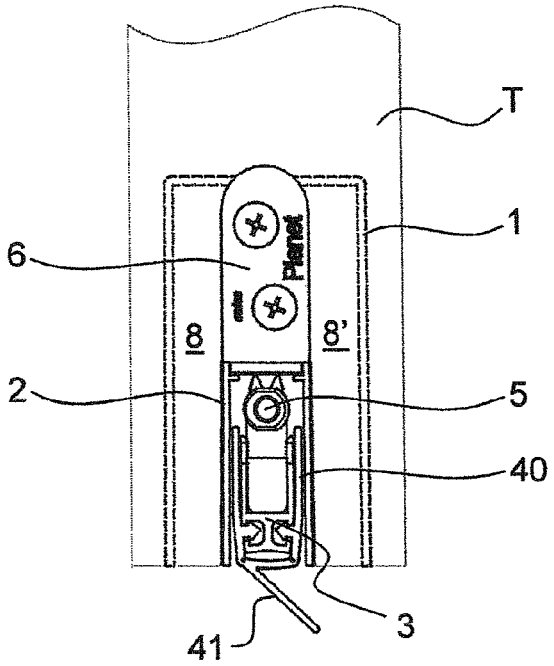
FIG. 11 shows a view of a door sealing system according to the invention according to a fourth embodiment from the front.
Figure 12:
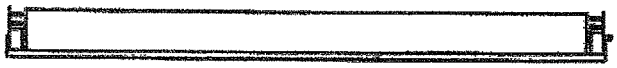
FIG. 12 shows a side view of the door sealing system according to FIG. 11.
Figure 13:
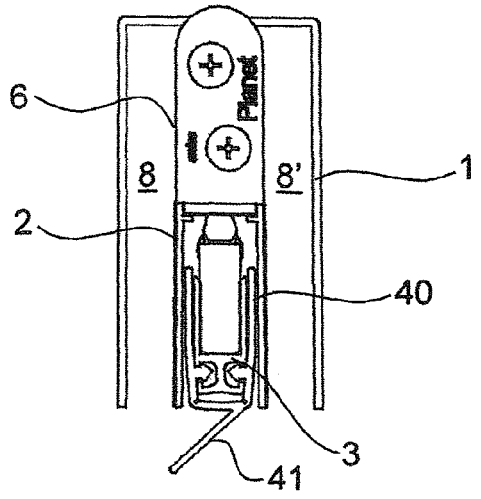
FIG. 13 shows a front view of the door sealing system according to FIG. 11.
Figure 14:
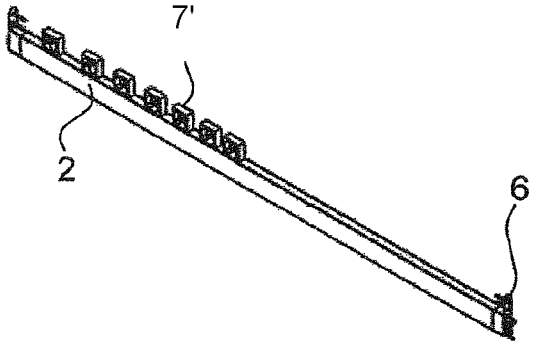
FIG. 14 shows a perspective illustration of the door sealing system according to FIG. 11 with axial fans and without an outer housing.

In the embodiment according to FIGS. 11 to 13, a plurality of radial fans 7' are arranged over at least part of the length of the seal housing 2. Said radial fans 7' are also, in turn, preferably fastened on the seal housing 2. The variations according to the previous exemplary embodiments are also possible here.

The radial fans 7' can be arranged distributed, preferably uniformly distributed, over the entire length of the seal housing 2. However, they could also be located in the region of one end. Preferably in the region at which the door is held pivotably in the door frame.

The radial fans 7' direct the air from one side of the door wing T to the other side. In this example, a special design of a flow duct is therefore not necessary. This has the advantage that the sealing system can be of overall narrower design.

Figure 15:
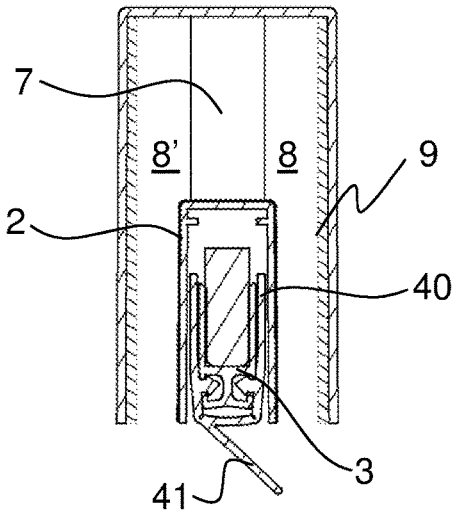
FIG. 15 shows a further cross section through the door sealing system according to FIG. 11.

FIG. 15 illustrates a damping element 9 which is fastened onto the inner sides of the two parallel limbs of the outer housing 1. Said damping element is preferably adhesively bonded thereto. The damping element 9 serves for sound damping. It is therefore a sound absorber. It can be designed as a simple, sound-absorbing mat, for example made from felt, or as Helmholtz resonator. It preferably extends approximately over the entire length of the sealing system.

The door sealing system according to the invention permits a sufficient exchange of air even when the door is closed.

LIST OF DESIGNATIONS

T Door wing
N Groove
1 Outer housing
2 Sealing housing
20 Hole
3 Support profiled rail
4 Sealing element
40 Lateral limb
41 Sealing lip
5 Actuating knob
6 Angle bracket
7 Fan
70 Flow duct
71 Inlet
72 Outlet
8, 8' Intermediate space
9 Damping element

The invention claimed is:

1. A door sealing system comprising:

an outer housing, a door seal partially disposed within the outer housing, the door seal comprising a sealing element, the sealing element having a sealing position for sealing between one of a lower side and an upper side of a building door wing and a respective one of a floor and a ceiling, and an air duct which, when the sealing element is in the sealing position, permits air to circulate from a first longitudinal side of the door seal to a second longitudinal side of the door seal, the second longitudinal side being opposite to the first longitudinal side, wherein the air duct runs along at least a part of the first longitudinal side and at least a part of the second longitudinal side, and wherein at least one fan is disposed in the air duct to move air through the air duct from the first longitudinal side to the second longitudinal side when the sealing element is in the sealing position, wherein the at least one fan is disposed in the outer housing between a top wall of the door seal and a top wall of the outer housing and between side walls of the outer housing, and wherein the at least one fan includes an arcuate flow duct with an inlet on the first longitudinal side of the door seal and an outlet on the second longitudinal side of the door seal.

2. The door sealing system as claimed in claim 1, wherein the door sealing system comprises a motor and wherein the at least one fan is operated by the motor.

3. The door sealing system as claimed in claim 1, wherein the at least one fan is fastened to one of the door seal and the outer housing.

4. The door sealing system as claimed in claim 1, wherein the fan and the door seal are connected to each other.

5. The door sealing system as claimed in claim 4, wherein said connection is airtight.

6. The door sealing system as claimed in claim 1, wherein the air duct is formed between the top wall of the door seal and the side walls of the outer housing.

7. The door sealing system as claimed in claim 1, the sealing element which is automatically lowered when the door wing is moved from an open position to a closed position and is automatically raised when the door wing is moved from the closed position to the open position.

8. The door sealing system as claimed in claim 1, wherein said door sealing system is designed for arrangement in a groove of the door wing and for fastening to said door wing.

9. The door sealing system as claimed in claim 1, wherein the at least one fan is operated by an electric motor.

* * * * *